US011724417B2

(12) United States Patent
Schlüsselbauer

(10) Patent No.: US 11,724,417 B2
(45) Date of Patent: Aug. 15, 2023

(54) METHOD FOR PRODUCING CONCRETE PIPES

(71) Applicant: Ulrich Schlüsselbauer, Altenhof am Hausruck (AT)

(72) Inventor: Ulrich Schlüsselbauer, Altenhof am Hausruck (AT)

( * ) Notice: Subject to any disclaimer, the term of this patent is extended or adjusted under 35 U.S.C. 154(b) by 62 days.

(21) Appl. No.: 15/765,444

(22) PCT Filed: Oct. 13, 2016

(86) PCT No.: PCT/AT2016/050260
§ 371 (c)(1),
(2) Date: Apr. 2, 2018

(87) PCT Pub. No.: WO2017/063010
PCT Pub. Date: Apr. 20, 2017

(65) Prior Publication Data

US 2018/0297234 A1 Oct. 18, 2018

(30) Foreign Application Priority Data

Oct. 16, 2015 (AT) ..... A 50881/2015

(51) Int. Cl.
*B28B 21/10* (2006.01)
*B28B 21/76* (2006.01)
*B28B 21/90* (2006.01)

(52) U.S. Cl.
CPC ..... *B28B 21/765* (2013.01); *B28B 21/10* (2013.01); *B28B 21/90* (2013.01)

(58) Field of Classification Search
CPC ..... B28B 7/0097; B28B 21/76; B28B 21/10; B28B 21/90; B28B 21/765; B28B 21/00; B28B 7/06; E04B 1/16
See application file for complete search history.

(56) References Cited

U.S. PATENT DOCUMENTS 2,334,509 A * 11/1943 Reeves ..... B28B 21/18 425/405.1
3,078,539 A 2/1963 Duplessis
(Continued)

FOREIGN PATENT DOCUMENTS

DE 33 23 340 A1 1/1985
GB 2137924 * 10/1984 ..... B28B 7/06
WO 2014/048684 A1 4/2014

OTHER PUBLICATIONS

Espacenet. English-language abstract of DE 33 23 340 A1, Prinzing Georg GmbH Co. KG, Jan. 3, 1985.

*Primary Examiner* — Galen H Hauth
*Assistant Examiner* — Shibin Liang
(74) *Attorney, Agent, or Firm* — Tiajoloff & Kelly LLP

(57) ABSTRACT

A method for producing concrete pipes in a vertical casting mould comprising a moulding space (4) between a core (2) and a mantle (3) divided lengthwise and comprising mould sleeves (5, 9) which terminate the moulding space (4) at the bottom and at the top is described, wherein pourable concrete is poured into the moulding space (4) and the pipe body (7) is demoulded after setting of the concrete by opening the mantle (3). In order to be able to cast high-quality concrete pipes, it is proposed that the pourable concrete is poured into the moulding space (4) in a predetermined quantity when the upper mould sleeve (9) is removed and that the upper mould sleeve (9) forming a closed ring is pressed in a shaping manner into the end face of the pipe body (7) only after a setting time for a predefined setting volume of the cast pipe body (7) between the core (2) and the mantle (3).

9 Claims, 2 Drawing Sheets

(56) References Cited

U.S. PATENT DOCUMENTS

| | | | | |
|---|---|---|---|---|
| 3,334,390 | A * | 8/1967 | Steiro | B28B 21/76<br>425/193 |
| 3,461,516 | A * | 8/1969 | Boucher | B28B 21/10<br>425/117 |
| 2005/0269747 | A1 | 12/2005 | Wuelfing | |
| 2015/0246460 | A1 | 9/2015 | Schluesselbauer | |

* cited by examiner

METHOD FOR PRODUCING CONCRETE PIPES

FIELD OF THE INVENTION

The invention relates to a method for producing concrete pipes in a vertical casting mould comprising a moulding space between a core and a mantle divided lengthwise and comprising mould sleeves which terminate the moulding space at the bottom and at the top, wherein pourable concrete is poured into the moulding space and the pipe body is demoulded after curing of the concrete by opening the mantle.

DESCRIPTION OF THE PRIOR ART

In contrast to a shaking pressing process, in a wet concrete casting method pourable concrete is poured into the moulding space of a casting mould, which has the result that the concrete body in the casting mould must cure before it can be demoulded. For the production of concrete pipes in vertical casting moulds this means that for demoulding the set concrete body, the divided mantle of the casting mould is either opened by expanding or radially pulling apart the mantle halves and the core is reduced in its diameter. Since the upper mould sleeve is assigned to the mantle, the upper mould sleeve must also be divided. However, the upper mould sleeve must allow a pouring of the pourable concrete into the moulding space from above which requires upper mould sleeves which are open on the front side, with the disadvantage that the end faces of the pipe body in the region of the open front sides of the upper mould sleeves must be smoothed by hand, and what is more, the setting behaviour of the pourable concrete poured into the moulding space can scarcely be taken into account. In the course of the setting process the air bubbles included in the pourable concrete escape upwards and can only partially escape via the open front side of the upper mould sleeve so that the air bubbles collecting in particular in the region of the outer circumferential wall of the upper mould sleeve cause undesired air pores in the region of the recessed front-side coupling attachments of the finished concrete pipes.

In order to be able to take into account the setting behaviour of concrete pipes produced by the shaking pressing method after demoulding, it is known (EP 0 476 245 A2) to press the upper mould sleeve in a shaping manner onto the compacted concrete body only after a compaction of the concrete caused by a shaking whilst displacing the excess concrete from the moulding space between mould core and mould mantle so that a uniformly compacted concrete body can be assumed even in the region of the coupling attachment formed by the upper mould sleeve. Apart from the fact that in a shaking pressing method, unlike a wet concrete casting method the difficulties caused by air bubbles ascending in the pourable concrete do not occur, in this known shaping pressing method to produce pipe bodies, the escape of the excess concrete from the moulding space should be seen as disadvantageous. In addition, a relative movement between the mould core and the mould mantle is required to be able to close the annular opening between the upper mould sleeve and the core, which annular opening is required to displace the excess concrete from the moulding space.

SUMMARY OF THE INVENTION

It is therefore the object of the invention to configure a wet concrete casting method to produce concrete pipes in the moulding space between a core and a mantle of a vertical casting mould so that not only the requirements for a true-to-size formation of the coupling attachments formed by the upper moulding sleeve are created but also the risk of the formation of air pores in the set concrete pipe can be avoided and the setting behaviour of the pourable concrete can be taken into account in a simple manner.

Starting from a method of the type described initially, the invention solves the formulated object in that the pourable concrete is poured into the moulding space in a predetermined quantity when the upper mould sleeve is removed and that the upper mould sleeve forming a closed ring is pressed in a shaping manner into the end face of the pipe body only after a setting time for a predefined setting volume of the cast pipe body between the core and the mantle.

Since the pourable concrete is cast in the moulding space when the upper mould sleeve is removed and the upper mould sleeve is pressed into the still pourable concrete only after a predefined setting time, the air bubbles ascending in the pipe body during the setting time can escape upwards unhindered through the upper mould sleeve, so that during the subsequent compression moulding of the front-side coupling attachment by pressing the upper mould sleeve into the still pourable concrete smooth wall surfaces can be formed not only in the circumferential region but also in the region of the front side. The waiting for the setting process for the concrete cast in the moulding space and the subsequent forming of the coupling attachment however requires a filling of the moulding space with a predefined quantity of pourable concrete in order to be able to ensure a predefined length of the concrete pipe to be produced. Accordingly a filling volume must be provided which exceeds the volume of the concrete pipe to be produced by the setting volume. The setting behaviour of different concrete compositions and therefore the respective setting volume to be taken into account can be determined simply for example by experiments. In practice, it has been found that even after a few minutes a setting is present which allows a compression moulding by the upper mould sleeve within a predefined manufacturing tolerance.

The compression moulding of the front-side coupling attachment of the concrete pipe to be produced can be assisted by turning the upper mould sleeve during and/or after the pressing into the pourable concrete.

BRIEF DESCRIPTION OF THE DRAWING

The method according to the invention is explained in detail with reference to the drawings. In the figures.

DESCRIPTION OF THE PREFERRED EMBODIMENT

Figure 1:
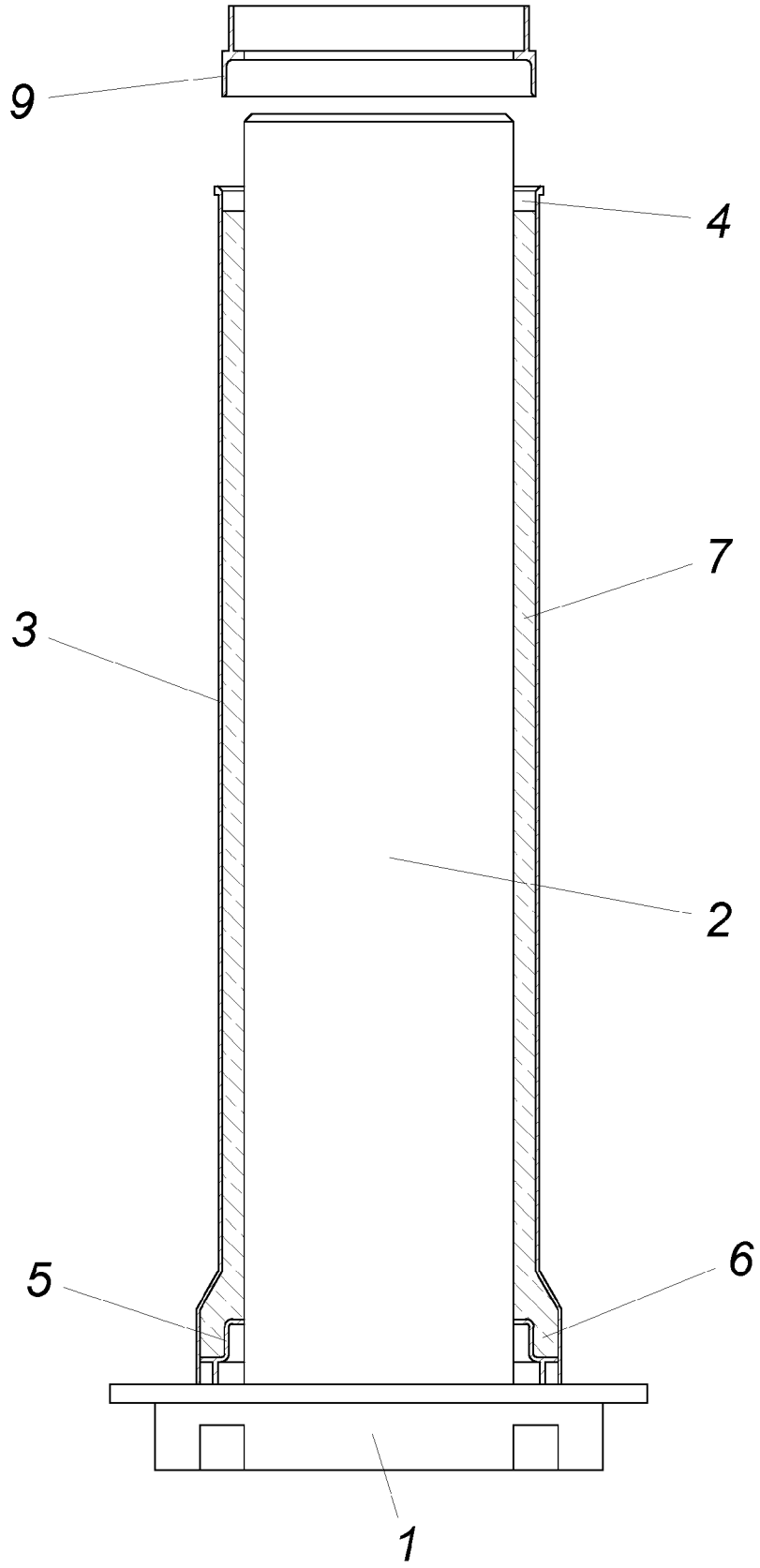
FIG. 1 shows a casting mould for carrying out a method of production according to the invention for concrete pipes in an axial section with an upper mould sleeve raised from the moulding space directly after filling with pourable concrete.
Figure 3:
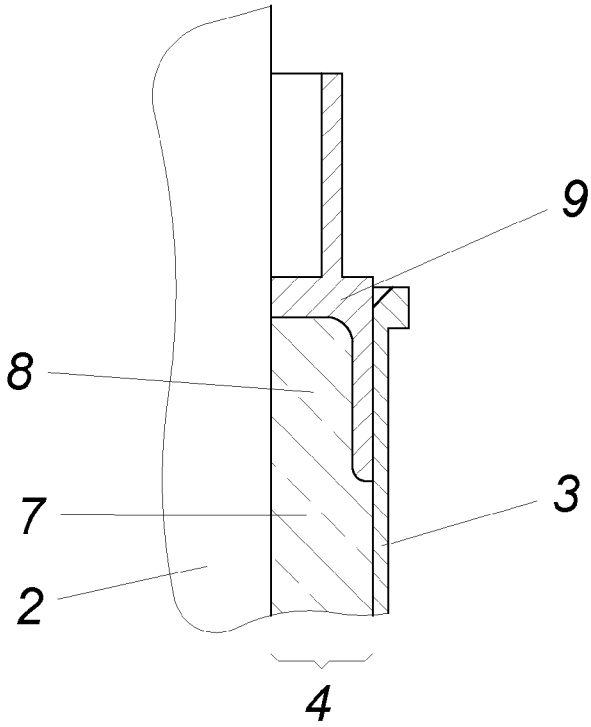

As can be deduced in particular from FIG. 1, a casting mould for carrying out the wet concrete casting method according to the invention to produce a concrete pipe has a base 1 with a core 2 and a mantle 3 between which and the core 2 an annular moulding space 4 is formed. At the bottom this moulding space 4 is terminated by a mould sleeve 5 which rests on the base 1 and combined with the mantle 3 provides for the formation of an extended sleeve 6 at the lower end of the pipe body 7 made of concrete. A separate upper mould sleeve 9 in the form of a closed ring which is inserted coaxially to the casting mould between the core 2 and the mantle 3 under pressure into the annular space 4 and preferably can be rotated about its axis is used to form a recessed coupling attachment 8 which is complementary to the sleeve 6, and which can be seen from FIG. 3 at the opposite end of the pipe body 7.

For demoulding a concrete pipe which has been produced, usually both the core 2 and also the mantle 3 are divided lengthwise. Whilst the mantle 3 must be withdrawn radially outwards from the concrete pipe to be demoulded, the core is to be drawn radially inwards to release the pipe body 7. This is achieved in a manner known per se whereby the longitudinal edges of the divided circumferential wall of the core 2 which run parallel to one another at a distance in the circumferential direction in the usage position of the core are pulled towards one another. In the case of a conical core configuration, a division of the core which is otherwise required can also be omitted. The longitudinal edges of the divided mantle 3 which abut against one another in the usage position of the mantle 3 are accordingly pulled apart. In the case of a one-piece design, the mantle 3 is thus widened whilst in the case of a two-part design the two mantle halves are pulled apart.

Figure 2:
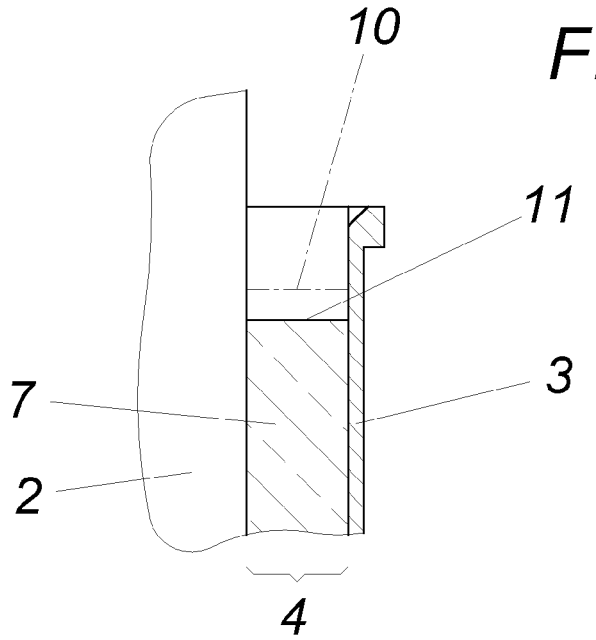
FIG. 2 shows the moulding space between core and mantle of the casting mould in sections in the region of the upper mould sleeve after the setting process of the pipe body made of pourable concrete in a larger scale and FIG. 3 shows a view corresponding to FIG. 2 of the casting mould after the shaping pressing of the upper mould sleeve into the pipe body.

In order to produce a concrete pipe, pourable concrete is poured in a predefined quantity matched to the pipe to be produced into the moulding space 4 between the core 2 and the mantle of the casting mould when the upper mould sleeve 9 is raised usually from above according to FIG. 1. In special cases however a pressing of the pourable concrete through a mantle opening into the moulding space 4 is possible. Before the upper mould sleeve 9 is pressed into the pipe body 7 onto pourable concrete to form a coupling attachment 8, a setting of the pipe body 7 is awaited. During this setting time the filling level of the moulding space 4 according to FIG. 2 drops from an initial level 10 indicated by a dot-dash line to a level 11 accompanied by compaction of the concrete. In order to shorten the setting time, the mantle and/or the core can be provided with a shaking drive.

The air bubbles enclosed in the pourable concrete can escape upwards from the moulding space 4 during this setting time so that during the subsequent pressing of the upper mould sleeve into the pourable concrete between the core 2 and the mantle 3 the coupling attachment 8 is formed free from pores with smooth wall surfaces. Care should merely be taken to ensure that the air collecting above the pipe body 7 during insertion of the upper mould sleeve 9 into the moulding space 4 can escape from the mould sleeve 9 which is ensured by the necessary guide gap between the upper mould sleeve 9 and the core 2.

After a curing of the concrete necessary for demoulding, the pipe body 7 can be demoulded by opening the mantle 3 and pulling it apart radially outwards and pulling the core 2 radially in. The upper mould sleeve 9 can remain on the pipe body 7 during the demoulding but can also be removed beforehand.

The invention claimed is:

1. A method for producing a concrete pipe from pourable wet concrete, wherein the concrete pipe has a pipe body with a predetermined cast pipe body volume, said method comprising:

providing a mold with a core and a mantle that is divided lengthwise, said core and said mantle defining a molding space therebetween with a volume greater than the predetermined cast pipe body volume, wherein said core extends above a height of an upper end of the concrete pipe to be formed, and upper and lower mold sleeves that terminate the molding space at a bottom and a top thereof;

pouring pourable wet concrete into the molding space so as to form the pipe body; and demolding the pipe body after curing of the concrete by opening the mantle;

wherein the pourable wet concrete is poured into the molding space in a predetermined quantity with the upper mold sleeve removed, wherein the predetermined quantity of the pourable wet concrete has a volume that is greater than the predetermined volume of the pipe body and that is determined as the predetermined volume of the pipe body plus a predefined setting volume that is determined based on setting behavior of the wet concrete; and the method further comprises pressing the upper mold sleeve as a closed ring in a shaping manner into an end face of the pipe body after said pouring and before said demolding, and after the volume of the pourable wet concrete has reduced to equal the predetermined volume of the pipe body, wherein none of the pourable wet concrete leaves the mold; and allowing a setting time to elapse with the upper sleeve remaining removed after the pouring and before the pressing of the upper mold sleeve, wherein the setting time is of sufficient duration such that during the setting time, for at least a period of minutes, air bubbles ascend and leave the pourable wet concrete so as to cause the pourable wet concrete to be reduced in volume after the setting time is elapsed by the predefined setting volume to a volume equal to the predetermined volume of the pipe body between the core and the mantle.

2. The method according to claim 1, wherein the upper mold sleeve is pressed into the pipe body between the core and the mantle and turned about an axis thereof.

3. The method according to claim 1, wherein said core has an outward cylindrical core surface, and said outward cylindrical core surface and said mantle define the molding space therebetween, and wherein said outward cylindrical core surface extends above a height of an upper end of the concrete pipe to be formed.

4. A method for producing a concrete pipe from pourable wet concrete, said method comprising:

providing a mold with a core surrounded by a mantle, said mantle being divided lengthwise thereof, said core and mantle defining a molding space therebetween with a volume greater than a predetermined cast pipe body volume of a cast pipe body of the concrete pipe, and said mantle having upper and lower mold sleeves that define top and bottom terminal ends of the molding space, the upper mold sleeve forming a closed ring, and said core extending above a height of an upper end of the concrete pipe to be formed;

pouring a predetermined quantity of pourable wet concrete into the molding space with the upper mold sleeve removed so as to form the cast pipe body of the concrete pipe between the core and the mantle, the predetermined quantity of wet concrete having a predetermined volume that is determined as the predetermined cast pipe body volume of the cast pipe body plus a predefined setting volume determined based on setting behavior of the wet concrete;

allowing passage of a setting time after said pouring of the predetermined quantity of the pourable wet concrete into the molding space with the upper mold sleeve removed during which air leaves the pourable wet concrete, the setting time being of sufficient duration such that during the passage of the setting time, for at least a period of minutes, air bubbles ascend in the pourable wet concrete and escape therefrom so that the predetermined quantity of pourable wet concrete is reduced in volume by the predefined setting volume so as to have a reduced volume equal to the predetermined cast pipe body volume;

after the allowing of the passage of the setting time, when the volume of the pourable wet concrete has reduced to the predetermined volume of the cast pipe body, pressing the upper mold sleeve into an upper portion of the pourable wet concrete so as to shape an end face of the cast pipe body wherein none of the pourable wet concrete leaves the mold; and demolding the cast pipe body after curing of the concrete by opening the mantle.

5. The method according to claim 4, wherein the upper mold sleeve is pressed into the pipe body between the core and the mantle and turned about an axis thereof.

6. The method according to claim 4, wherein said core has an outward cylindrical core surface, and said outward cylindrical core surface and said mantle define the molding space therebetween, and wherein said outward cylindrical core surface extends above a height of an upper end of the concrete pipe to be formed.

7. A method for producing a concrete pipe from pourable wet concrete, wherein the concrete pipe has with a cast pipe body having a predetermined cast pipe body volume, said method comprising:

pouring a predetermined quantity of pourable wet concrete into a vertical mold with a vertical core surrounded by a mantle, said core and mantle defining a molding space therebetween configured to receive the predetermined quantity of pourable wet concrete therein;

said mantle being divided lengthwise thereof and having upper and lower mold sleeves that define top and bottom terminal ends of the molding space, the upper mold sleeve comprising a closed ring that is removed during said pouring of the pourable wet concrete;

the predetermined quantity of wet concrete being in an amount that has a predetermined volume determined as the predefined cast pipe body volume of the cast pipe body plus a predefined setting volume of the pourable wet concrete that is based on setting behavior of the pourable wet concrete;

after said pouring of the entire predetermined quantity of the pourable wet concrete into the molding space, allowing passage of a setting time with the upper mold sleeve removed during which, for at least a period of minutes, air ascends as air bubbles in the pourable wet concrete and leaves the pourable wet concrete, the setting time being of sufficient duration that, during the setting time, the predetermined quantity of pourable wet concrete reduces in volume by the predefined setting volume to a reduced volume equal to the predetermined cast pipe body volume;

after said allowing of the passage of the setting time wherein the volume of the pourable wet concrete has reduced to the predetermined volume of the pipe body, applying the upper mold sleeve into an upper surface of the pourable wet concrete so as to shape the end face of the cast pipe body, wherein none of the pourable wet concrete leaves the mold; and opening the mantle; and demolding the cast pipe body after curing of the wet concrete.

8. The method according to claim 7, wherein said core has an outward cylindrical core surface, and said outward cylindrical core surface and said mantle define the molding space therebetween, and wherein said outward cylindrical core surface extends above a height of an upper end of the concrete pipe to be formed.

9. The method according to claim 7, wherein the applying of the upper mold sleeve to the upper surface of the pourable wet concrete comprises pressing the upper mold sleeve into the upper surface of the pourable wet concrete between the core and the mantle and turning the upper mold sleeve about an axis thereof.

* * * * *